US011254123B2

(12) United States Patent
Kawatoko et al.

(10) Patent No.: US 11,254,123 B2
(45) Date of Patent: Feb. 22, 2022

(54) INKJET PRINTING APPARATUS, INKJET PRINTING METHOD, AND STORAGE MEDIUM

(71) Applicant: CANON KABUSHIKI KAISHA, Tokyo (JP)

(72) Inventors: Norihiro Kawatoko, Yokohama (JP); Kentaro Muro, Tokyo (JP); Masashi Hayashi, Yokohama (JP); Eiji Komamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/557,452

(22) Filed: Aug. 30, 2019

(65) Prior Publication Data

US 2020/0070504 A1 Mar. 5, 2020

(30) Foreign Application Priority Data

Sep. 3, 2018 (JP) ..... JP2018-164781

(51) Int. Cl.
*B41J 29/393* (2006.01)
*B41J 2/045* (2006.01)

(52) U.S. Cl.
CPC ..... *B41J 2/04508* (2013.01); *B41J 2/04586* (2013.01); *B41J 29/393* (2013.01)

(58) Field of Classification Search
None
See application file for complete search history.

(56) References Cited

U.S. PATENT DOCUMENTS

| | | | | |
|---|---|---|---|---|
| 6,164,754 | A | 12/2000 | Ide et al. | |
| 6,334,659 | B1 | 1/2002 | Maeda et al. | |
| 6,364,446 | B1 | 4/2002 | Ishikawa et al. | |
| 6,557,982 | B2 | 5/2003 | Murakami et al. | |
| 6,568,784 | B2 * | 5/2003 | Izumi | B41J 2/01 347/16 |
| 6,572,212 | B2 | 6/2003 | Konno et al. | |
| 6,580,460 | B1 | 6/2003 | Takahashi et al. | |
| 6,644,770 | B1 | 11/2003 | Niimura et al. | |
| 6,729,709 | B2 | 5/2004 | Konno et al. | |
| 6,733,100 | B1 | 5/2004 | Fujita et al. | |

(Continued)

FOREIGN PATENT DOCUMENTS

JP 2012-035477 A 2/2012

*Primary Examiner* — Alejandro Valencia
(74) *Attorney, Agent, or Firm* — Venable LLP

(57) ABSTRACT

A print medium is conveyed in a first direction and a print head is provided with a reference side nozzle array and a plurality of nonreference side nozzle arrays. A relative position displacement amount between a reference printing position of a reference pattern printed by the reference side nozzle array and a nonreference printing position of each of nonreference patterns printed by each of the nonreference side nozzle arrays is detected. Based on a maximum value of a displacement amount of the reference printing position with respect to each of the nonreference printing positions in a direction opposite to the first direction, a first correction value for correcting displacement of the reference printing position is calculated. With reference to the reference printing position after corrected based on the first correction value, a second correction value for correcting displacement is calculated for each of the nonreference printing positions.

19 Claims, 14 Drawing Sheets

(56) References Cited

U.S. PATENT DOCUMENTS 6,808,247 B2 10/2004 Kawatoko et al.
6,827,413 B1 12/2004 Kawatoko et al.
6,921,218 B2 7/2005 Moriyama et al.
6,957,880 B2 10/2005 Kawatoko et al.
6,960,036 B1 11/2005 Fujita et al.
7,048,351 B2 5/2006 Kawatoko
7,052,191 B2 5/2006 Moriyama et al.
7,057,756 B2 6/2006 Ogasahara et al.
7,290,855 B2 11/2007 Chikuma et al.
7,296,872 B2 11/2007 Hayashi et al.
7,325,900 B2 2/2008 Hayashi et al.
7,344,219 B2 3/2008 Sakamoto et al.
7,524,011 B2 4/2009 Kawatoko
7,600,835 B2 10/2009 Moriyama et al.
7,618,116 B2 11/2009 Hamasaki et al.
7,706,023 B2 4/2010 Kanda et al.
7,959,246 B2 6/2011 Hamasaki et al.
8,147,019 B2 4/2012 Fujita et al.
8,251,480 B2 8/2012 Moriyama et al.
8,287,074 B2 10/2012 Kano et al.
8,313,188 B2 11/2012 Muro et al.
8,384,944 B2 2/2013 Kawatoko et al.
8,430,472 B2 4/2013 Nishikori et al.
8,444,246 B2 5/2013 Muro et al.
8,608,271 B2 12/2013 Murayama et al.
8,622,501 B2 1/2014 Komamiya et al.
8,675,250 B2 3/2014 Muro et al.
8,757,754 B2 6/2014 Azuma et al.
8,864,266 B2 10/2014 Suzuki et al.
8,955,956 B2 2/2015 Yamomoto et al.
8,979,238 B2 3/2015 Nishikori et al.
9,016,821 B2 4/2015 Masuda et al.
9,028,029 B2 5/2015 Azuma et al.
9,039,112 B2 5/2015 Murayama et al.
9,079,421 B2 7/2015 Kato et al.
9,108,403 B2 8/2015 Kawatoko et al.
9,114,631 B2 8/2015 Fujita et al.
9,138,989 B2 9/2015 Kawatoko et al.
9,162,496 B2 10/2015 Muro
9,340,009 B2 5/2016 Murayama et al.
9,393,790 B2 7/2016 Kano et al.
9,457,586 B2 10/2016 Fujita et al.
9,498,961 B2 11/2016 Kano et al.
9,636,906 B2 5/2017 Kawatoko et al.
9,764,562 B2 9/2017 Suzuki et al.
2005/0062784 A1* 3/2005 Matsuzaki ..... B41J 2/04573 347/19
2009/0079777 A1 3/2009 Nagamura et al.
2011/0109710 A1 5/2011 Miyakoshi et al.
2011/0310152 A1 12/2011 Muro et al.
2012/0033006 A1 2/2012 Murayama et al.
2012/0274951 A1 11/2012 Nishikori et al.
2019/0299592 A1 10/2019 Iwasaki et al.
2019/0299601 A1 10/2019 Oikawa et al.

* cited by examiner

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| THE NUMBER OF EJECTIONS OF K INK ($\times 10^7$) | 0 | 0 | 0 | 0 | 0 | 0 | 0 | 8 | 0 | 0 | 0 | 0 |
| THE NUMBER OF EJECTIONS OF C INK ($\times 10^7$) | 0 | 0 | 0 | 0 | 8 | 8 | 0 | 0 | 0 | 0 | 0 | 0 |

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| RELATIVE COLOR SHIFT AMOUNT (DETECTION VALUE) | 0 | 0 | 0 | 0 | 1 | 1 | 0 | −1 | 0 | 0 | 0 | 0 |

| CHIP (FOR K INK) | C1 | | | | C2 | | | | C3 | | | |
|---|---|---|---|---|---|---|---|---|---|---|---|---|
| GROUP (FOR K INK) | G0 | G1 | G2 | G3 | G0 | G1 | G2 | G3 | G0 | G1 | G2 | G3 |
| CORRECTION VALUE (FOR K INK) | 0 | 0 | 0 | 0 | 0 | 0 | 0 | 1 | 0 | 0 | 0 | 0 |

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| CORRECTION VALUE (FOR K INK) | 0 | 0 | 0 | 0 | 0 | 0 | 0 | 1 | 0 | 0 | 0 | 0 |
| RELATIVE COLOR SHIFT AMOUNT (DETECTION VALUE) | 0 | 0 | 0 | 0 | 1 | 1 | 0 | −1 | 0 | 0 | 0 | 0 |
| RELATIVE COLOR SHIFT AMOUNT (AFTER CORRECTION OF K) | 0 | 0 | 0 | 0 | 1 | 1 | 0 | 0 | 0 | 0 | 0 | 0 |

| CHIP (FOR C INK) | C1 | | | | C2 | | | | C3 | | | |
|---|---|---|---|---|---|---|---|---|---|---|---|---|
| GROUP (FOR C INK) | G0 | G1 | G2 | G3 | G0 | G1 | G2 | G3 | G0 | G1 | G2 | G3 |
| CORRECTION VALUE (FOR C INK) | 0 | 0 | 0 | 0 | 1 | 1 | 0 | 0 | 0 | 0 | 0 | 0 |

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| THE NUMBER OF EJECTIONS OF K INK ($\times 10^7$) | 0 | 0 | 0 | 0 | 8 | 0 | 0 | 8 | 8 | 0 | 0 | 8 |
| THE NUMBER OF EJECTIONS OF C INK ($\times 10^7$) | 0 | 0 | 0 | 0 | 8 | 8 | 0 | 0 | 0 | 0 | 0 | 0 |
| THE NUMBER OF EJECTIONS OF M INK ($\times 10^7$) | 0 | 0 | 0 | 0 | 0 | 8 | 0 | 0 | 8 | 0 | 0 | 0 |
| THE NUMBER OF EJECTIONS OF Y INK ($\times 10^7$) | 0 | 8 | 0 | 8 | 0 | 0 | 0 | 0 | 8 | 0 | 0 | 0 |

FIG.12A

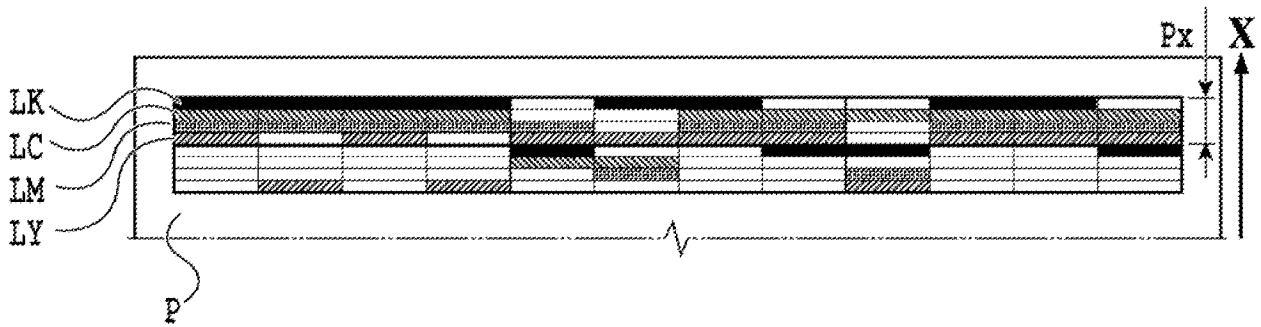

FIG.12B

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| COLOR SHIFT AMOUNT BETWEEN K-C (DETECTION VALUE) | – | – | 0 | 0 | 0 | 1 | 0 | −1 | −1 | 0 | – | – |
| COLOR SHIFT AMOUNT BETWEEN K-M (DETECTION VALUE) | – | – | 0 | 0 | −1 | 1 | 0 | −1 | 0 | 0 | – | – |
| COLOR SHIFT AMOUNT BETWEEN K-Y (DETECTION VALUE) | – | – | 0 | 1 | −1 | 0 | 0 | −1 | 0 | 0 | – | – |
| | R1 | | R0 | | | | | | | | R2 | |

FIG.12C

FIG.13A

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| CORRECTION VALUE FOR K INK (WITHIN DETECTION AREA) | – | – | 0 | 0 | 1 | 0 | 0 | 1 | 1 | 0 | – | – |
| CORRECTION VALUE FOR K INK (OUTSIDE DETECTION AREA) | 0 | 0 | – | – | – | – | – | – | – | – | 0 | 1 |
| CORRECTION VALUE FOR K INK (FINAL VALUE) | 0 | 0 | 0 | 0 | 1 | 0 | 0 | 1 | 1 | 0 | 0 | 1 |

FIG.13B

| CHIP (FOR K INK) | C1 | | | | C2 | | | | C3 | | | |
|---|---|---|---|---|---|---|---|---|---|---|---|---|
| GROUP (FOR K INK) | G0 | G1 | G2 | G3 | G0 | G1 | G2 | G3 | G0 | G1 | G2 | G3 |
| CORRECTION VALUE FOR K INK (FINAL VALUE) | 0 | 0 | 0 | 0 | 1 | 0 | 0 | 1 | 1 | 0 | 0 | 1 |
| COLOR SHIFT AMOUNT BETWEEN K-C (DETECTION VALUE) | – | – | 0 | 0 | 0 | 1 | 0 | −1 | −1 | 0 | – | – |
| COLOR SHIFT AMOUNT BETWEEN K-C (AFTER CORRECTION OF K) | – | – | 0 | 0 | 1 | 1 | 0 | 0 | 0 | 0 | – | – |

FIG.13C

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| CORRECTION VALUE FOR C INK (WITHIN DETECTION AREA) | – | – | 0 | 0 | 1 | 1 | 0 | 0 | 0 | 0 | – | – |
| CORRECTION VALUE FOR C INK (OUTSIDE DETECTION AREA) | 0 | 0 | – | – | – | – | – | – | – | – | 0 | 0 |
| CORRECTION VALUE FOR C INK (FINAL VALUE) | 0 | 0 | 0 | 0 | 1 | 1 | 0 | 0 | 0 | 0 | 0 | 0 |

FIG.13D

| CHIP | C1 | | | | C2 | | | | C3 | | | |
|---|---|---|---|---|---|---|---|---|---|---|---|---|
| GROUP | G0 | G1 | G2 | G3 | G0 | G1 | G2 | G3 | G0 | G1 | G2 | G3 |
| CORRECTION VALUE FOR K INK (FINAL VALUE) | 0 | 0 | 0 | 0 | 1 | 0 | 0 | 1 | 1 | 0 | 0 | 1 |
| CORRECTION VALUE FOR C INK (FINAL VALUE) | 0 | 0 | 0 | 0 | 1 | 1 | 0 | 0 | 0 | 0 | 0 | 0 |
| CORRECTION VALUE FOR M INK (FINAL VALUE) | 0 | 0 | 0 | 0 | 0 | 1 | 0 | 0 | 1 | 0 | 0 | 0 |
| CORRECTION VALUE FOR Y INK (FINAL VALUE) | 0 | 1 | 0 | 1 | 0 | 0 | 0 | 0 | 1 | 0 | 0 | 0 |

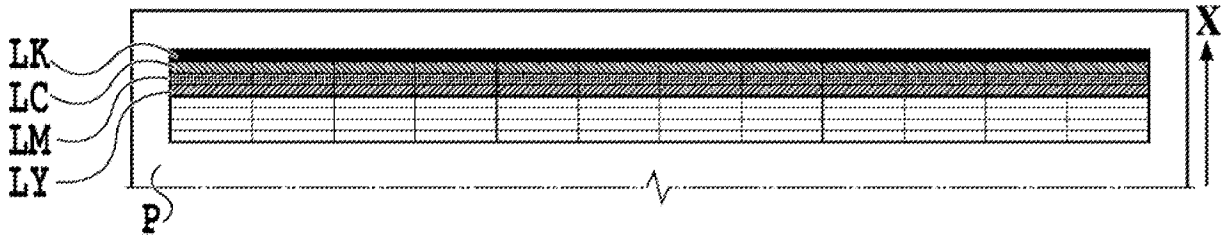

INKJET PRINTING APPARATUS, INKJET PRINTING METHOD, AND STORAGE MEDIUM

BACKGROUND OF THE INVENTION

Field of the Invention

The present invention relates to a full-line type inkjet printing apparatus that prints an image by using a plurality of nozzle arrays, an inkjet printing method, and a storage medium that stores a program for executing the inkjet printing method.

Description of the Related Art

The full-line type inkjet printing apparatus uses an elongated print head in which a nozzle array extends across the entire area in a width direction of a printing area of a print medium. Then, the full-line type inkjet printing apparatus prints an image by ejecting ink from nozzles of the print head while continuously conveying the print medium in a direction crossing the nozzle array. In a case where the full-line type inkjet printing apparatus ejects different types of ink from a plurality of nozzle arrays of the print head and prints a multicolor image, displacement (color shift) of landing positions of multiple colors of ink printing the same pixel causes a lower quality of a printed image. Examples of the displacement of ink landing positions (printing position displacement) include displacement that occurs at an early stage of the use of the print head due to an installation error of the print head and displacement that occurs along with the use of the print head, according to the use situation of nozzles. In the full-line type inkjet printing apparatus, the relation between the position of the nozzles of the print head and the position of the print medium in a width direction is fixed. Therefore, the displacement of ink landing positions has a greater impact on a printed image as compared to a serial scan-type inkjet printing apparatus capable of printing one line in a scanning direction of the print head by using a plurality of nozzles.

Japanese Patent Laid-Open No. 2012-35477 discloses a method for coping with the displacement of ink landing positions that occurs at an early stage of the use of a print head due to an installation error of the print head in a serial scan-type inkjet printing apparatus using a plurality of nozzle arrays of the print head. That is, based on a relative positional relation among a plurality of patterns printed on a print medium, a displacement amount from an ideal ink landing position is calculated and the ink landing position is corrected based on the displacement amount.

SUMMARY OF THE INVENTION

However, the method disclosed in Japanese Patent Laid-Open No. 2012-35477 cannot cope with the displacement of ink landing positions that occurs along with the use of the print head. That is, in Japanese Patent Laid-Open No. 2012-35477, in a case where the displacement of landing positions of ink ejected from the nozzles occurs according to the use situation of the nozzles that print a plurality of patterns, the ink landing positions become misaligned within these patterns. As a result, a displacement amount of ink landing positions cannot be accurately calculated.

The present invention provides an inkjet printing apparatus for correcting printing position displacement that occurs along with the use of a print head in a full-line type inkjet printing apparatus, an inkjet printing method, and a storage medium.

In the first aspect of the present invention, there is provided an inkjet printing apparatus comprising:

a conveying unit configured to convey a print medium in a first direction;

a print head provided with a reference side nozzle array and a plurality of nonreference side nozzle arrays in a second direction crossing the first direction, each nozzle array provided with a plurality of nozzles capable of ejecting ink;

a pattern printing control unit configured to cause the print head to print, in a same position on the print medium, a reference pattern printed by the reference side nozzle array and a nonreference pattern printed by each of the plurality of nonreference side nozzle arrays;

a detecting unit configured to detect, based on a printing result of the reference pattern and each of the nonreference patterns, a relative position displacement amount between a reference printing position of the reference pattern and a nonreference printing position of each of the nonreference patterns;

a first calculating unit configured to calculate, based on a maximum value of a displacement amount of the reference printing position with respect to each of the nonreference printing positions in a direction opposite to the first direction, a first correction value for correcting displacement of the reference printing position in the opposite direction;

a second calculating unit configured to calculate, with reference to the reference printing position after corrected based on the first correction value, a second correction value for correcting displacement in the opposite direction for each of the nonreference printing positions; and an image printing control unit configured to print an image on the print medium by controlling the print head to correct a printing position of the reference side nozzle array according to the first correction value and correct a printing position of each of the plurality of nonreference side nozzle arrays according to the second correction value.

In the second aspect of the present invention, there is provided an inkjet printing apparatus comprising:

a conveying unit configured to convey a print medium in a first direction;

a print head provided with a first nozzle array and a second nozzle array in a second direction crossing the first direction, each nozzle array provided with a plurality of nozzles capable of ejecting ink;

a pattern printing control unit configured to cause the print head to print, in a same position on the print medium, a first pattern printed by the first nozzle array and a second pattern printed by the second nozzle array;

a detecting unit configured to detect, based on a printing result of the first and second patterns, a relative position displacement amount between a first printing position of the first pattern and a second printing position of the second pattern;

a first calculating unit configured to calculate, based on the relative position displacement amount, a first correction value for correcting displacement of the first printing position in a direction opposite to the first direction with reference to the second printing position;

a second calculating unit configured to calculate, with reference to the first printing position after corrected based on the first correction value, a second correction value for correcting displacement of the second printing position in the opposite direction; and an image printing control unit configured to print an image on the print medium by controlling the print head to correct a printing position of the first nozzle array according to the first correction value and correct a printing position of the second nozzle array according to the second correction value.

In the third aspect of the present invention, there is provided an inkjet printing method comprising:

a conveying step of conveying a print medium in a first direction;

a pattern printing control step of controlling a print head provided with a reference side nozzle array and a plurality of nonreference side nozzle arrays in a second direction crossing the first direction, each nozzle array provided with a plurality of nozzles capable of ejecting ink, to print, in a same position on the print medium conveyed in the first direction, a reference pattern printed by the reference side nozzle array and a nonreference pattern printed by each of the plurality of nonreference side nozzle arrays;

a detecting step of detecting, based on a printing result of the reference pattern and each of the nonreference patterns, a relative position displacement amount between a reference printing position of the reference pattern and a nonreference printing position of each of the nonreference patterns;

a first calculating step of calculating, based on a maximum value of a displacement amount of the reference printing position with respect to each of the nonreference printing positions in a direction opposite to the first direction, a first correction value for correcting displacement of the reference printing position in the opposite direction;

a second calculating step of calculating, with reference to the reference printing position after corrected based on the first correction value, a second correction value for correcting displacement in the opposite direction for each of the nonreference printing positions; and an image printing control step of printing an image on the print medium by controlling the print head to correct a printing position of the reference side nozzle array according to the first correction value and correct a printing position of each of the plurality of nonreference side nozzle arrays according to the second correction value.

In the fourth aspect of the present invention, there is provided a non-transitory computer readable storage medium having stored therein a program for causing a computer to execute an inkjet printing method, the inkjet printing method comprising:

a conveying step of conveying a print medium in a first direction;

a pattern printing control step of causing a print head provided with a first nozzle array and a second nozzle array in a second direction crossing the first direction, each nozzle array provided with a plurality of nozzles capable of ejecting ink, to print, in a same position on the print medium conveyed in the first direction, a first pattern printed by the first nozzle array and a second pattern printed by the second nozzle array;

a detecting step of detecting, based on a printing result of the first and second patterns, a relative position displacement amount between a first printing position of the first pattern and a second printing position of the second pattern;

a first calculating step of calculating, based on the relative position displacement amount, a first correction value for correcting displacement of the first printing position in a direction opposite to the first direction with reference to the second printing position;

a second calculating step of calculating, with reference to the first printing position after corrected based on the first correction value, a second correction value for correcting displacement of the second printing position in the opposite direction; and an image printing control step of printing an image on the print medium by controlling the print head to correct a printing position of the first nozzle array according to the first correction value and correct a printing position of the second nozzle array according to the second correction value.

According to the present invention, the full-line type inkjet printing apparatus can detect printing position displacement among a plurality of nozzle arrays that occurs along with the use of the print head and correct the displacement.

Further features of the present invention will become apparent from the following description of exemplary embodiments with reference to the attached drawings.

BRIEF DESCRIPTION OF THE DRAWINGS

FIG. 12A, FIG. 12B, and FIG. 12C are diagrams explaining a method for detecting printing position displacement among four nozzle arrays;

FIG. 13A, FIG. 13B, FIG. 13C, and FIG. 13D are diagrams explaining a method for correcting printing position displacement among four nozzle arrays.

DESCRIPTION OF THE EMBODIMENTS

Embodiments of the present invention will be described based on the drawings.

First Embodiment

Figure 1:
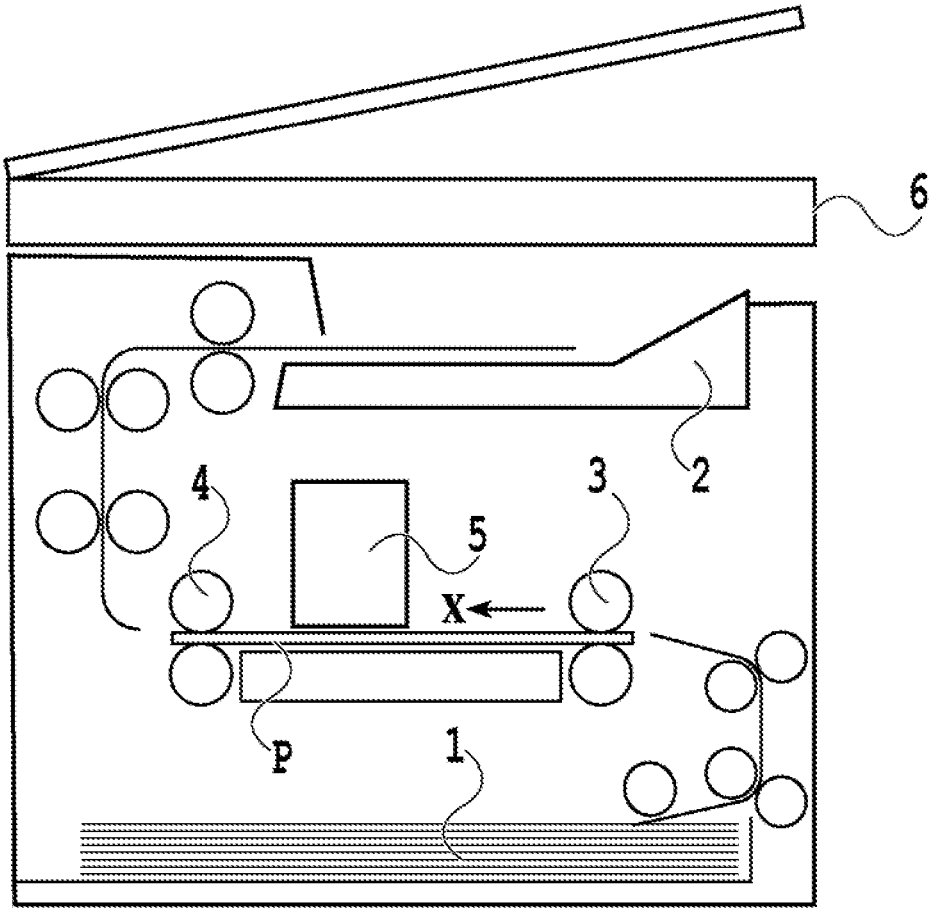
FIG. 1 is a schematic configuration diagram of an inkjet printing apparatus according to a first embodiment of the present invention.

FIG. 1 is a diagram showing an internal configuration of an inkjet printing apparatus (printing apparatus) according to the present embodiment.

A print medium P fed from a feeding unit 1 is conveyed at a predetermined speed in an X direction (conveying direction) while being sandwiched between conveying roller pairs 3 and 4, and then is discharged to a discharging unit 2. Between the conveying roller pair 3 in an upstream side and the conveying roller pair 4 in a downstream side, there is provided an inkjet print head (print head) capable of ejecting two or more colors of ink toward the print medium P based on print data. Furthermore, the printing apparatus is provided with a scanner 6 for scanning an image printed on the print medium P. The print data is generated by performing various kinds of processing such as color conversion processing and quantization processing on image data represented in RGB values corresponding to the image printed on the print medium P. According to this print data, information indicating ejection or nonejection of ink is specified for each pixel on the print medium.

Figure 2A:
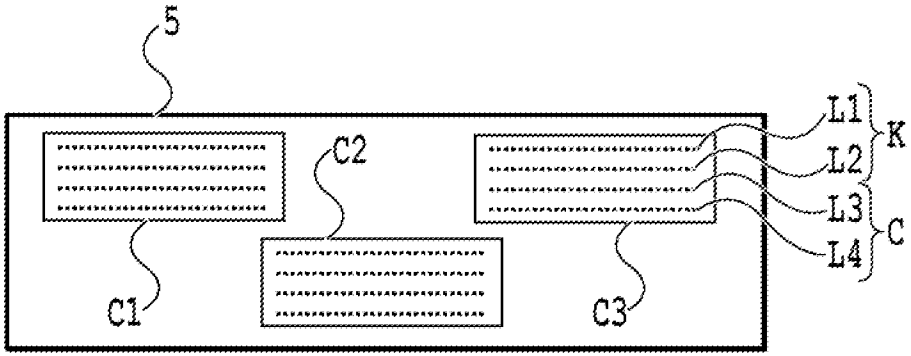
FIG. 2A and FIG. 2B are schematic configuration diagrams of a print head of FIG. 1.
Figure 2B:
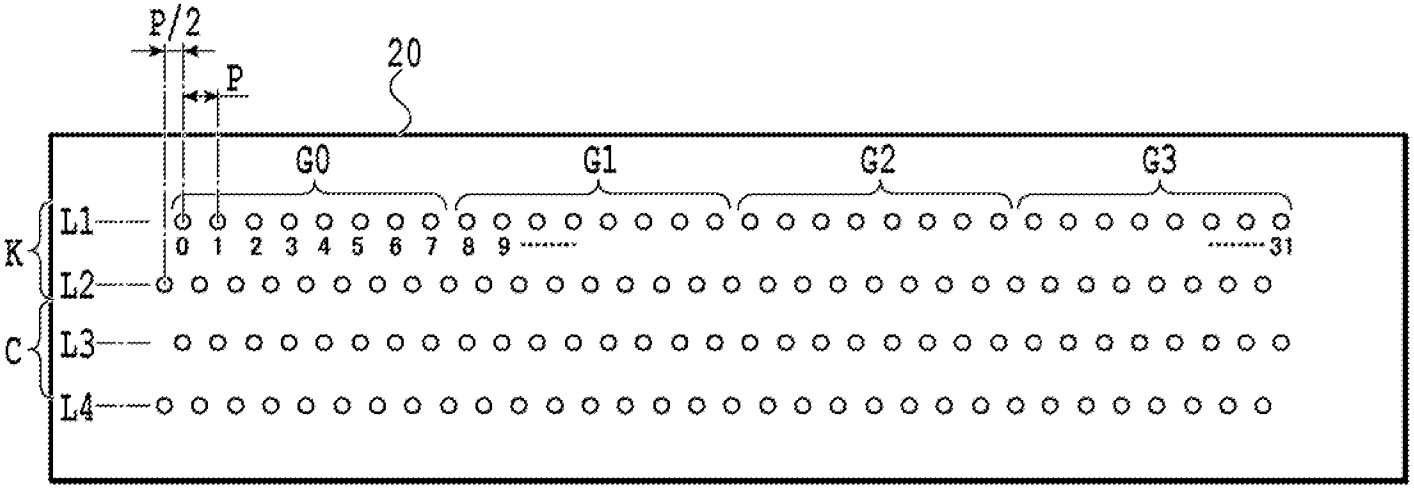

FIG. 2A and FIG. 2B are diagrams explaining the print head 5. The print head 5 in this example has two nozzle arrays L1, L2 for ejecting black ink K and two nozzle arrays L3, L4 for ejecting cyan ink C. The print head 5 in this example includes chips C1, C2, C3 each having the nozzle arrays L1, L2, L3, L4 formed thereon, and each nozzle array in the chip has 32 ejection ports in total, corresponding to the nozzle numbers 0 to 31. Each nozzle is composed of an ejection port, an ejection energy generating element such as an electrothermal transducer (heater) and a piezoelectric element for causing ink to be ejected from the ejection port, and the like. A distance (nozzle pitch) between the ejection ports in the nozzle arrays L1, L2, L3, L4 is equally a pitch P, and the nozzle arrays L1, L2 are displaced from each other by a half pitch (P/2), and similarly, the nozzle arrays L3, L4 are also displaced from each other by a half pitch (P/2). These nozzle arrays extend in a direction crossing (perpendicular to, in this example) the conveying direction (the arrow X direction) of the print medium P. The nozzles in each of these nozzle arrays are divided into four groups (blocks) G0, G1, G2, G3, each having eight nozzles. Furthermore, for convenience in explaining, the nozzle arrays in the chips that are adjacent to each other do not overlap each other in the nozzle array direction. However, the nozzles in the nozzle arrays may overlap each other in the nozzle array direction.

Figure 3:
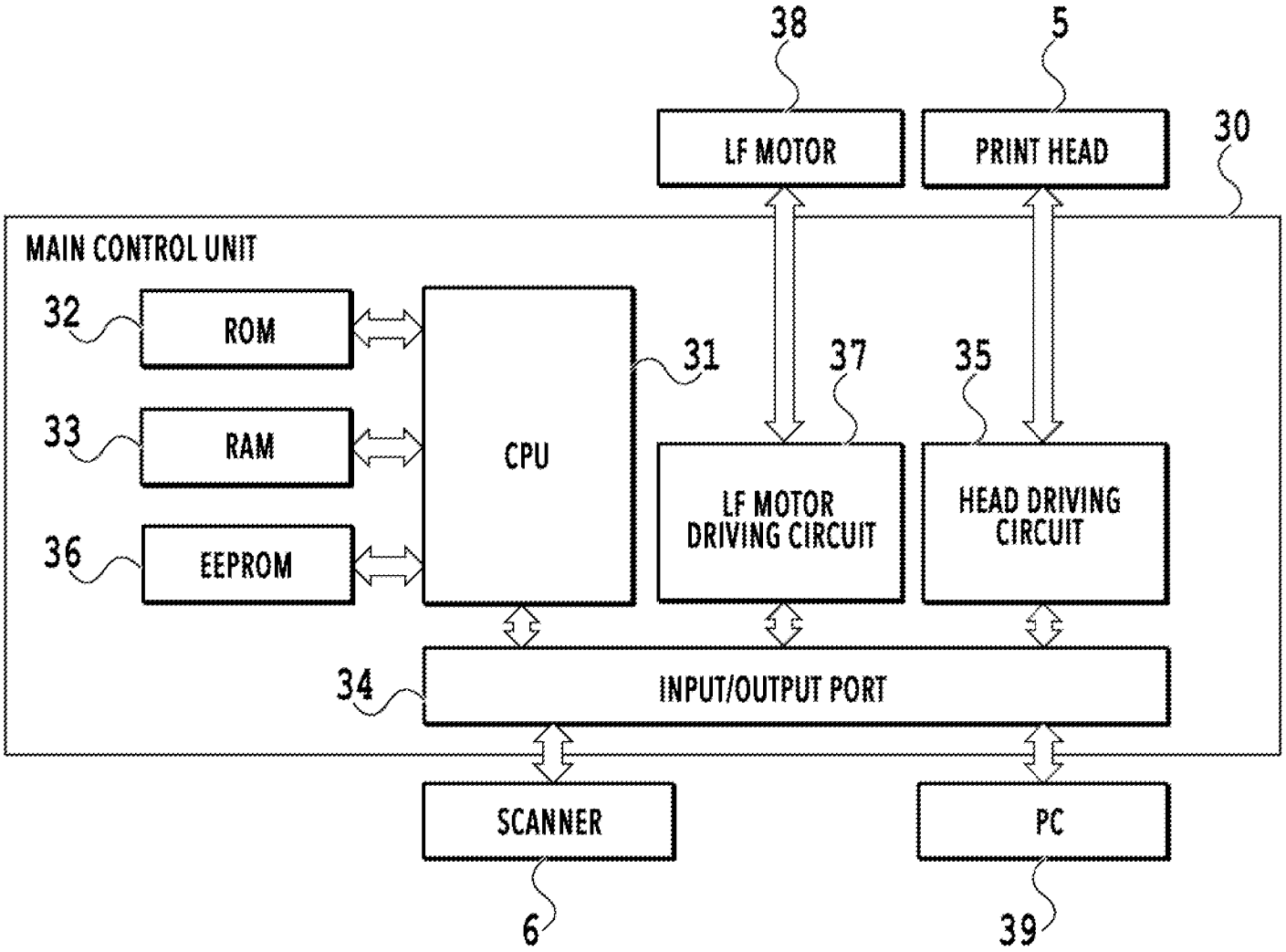
FIG. 3 is a block diagram of a control system of the printing apparatus of FIG. 1.

FIG. 3 is a block diagram showing a schematic configuration of a control system according to the present embodiment. A main control unit 30 has a CPU 31, a ROM 32, a RAM 33, an EEPROM 36, and an input/output port 34. The CPU 31 executes processing operations such as computing, selecting, determining, and controlling. The ROM 32 stores a control program and the like to be executed by the CPU 31. The RAM 33 is used as a buffer and the like for print data. The EEPROM 36 stores image data and a mask pattern. To the input/output port 34, driving circuits 37, 35 respectively corresponding to a conveying motor (LF motor) 38 and the print head 5 and the scanner 6 are connected. The main control unit 30 is connected to a PC 39, which is a host computer (host device).

Figure 4:
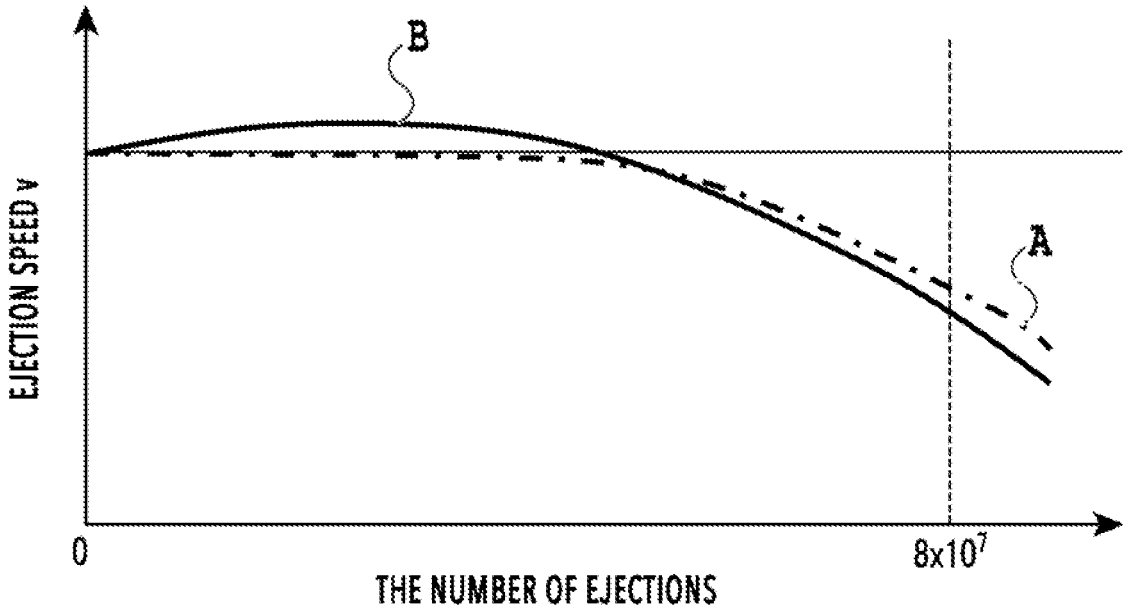
FIG. 4 is a graph showing the relation between the number of ink ejections and an ink ejection speed in the print head.

FIG. 4 is a graph showing the relation between the number of ink ejections (corresponding to the number of ink dots formed) from each of the nozzles of the print head 5 and an ink ejection speed that changes along with the increase in the number of ejections. As shown by a broken line A in FIG. 4, as the number of ink ejections increases, the ink ejection speed gradually decreases. Depending on the configuration of the print head, the type of ink, the environment conditions, and the like, as indicated by a solid line B in FIG. 4, the ejection speed decreases in the end even if the ink ejection speed temporarily increases. Decrease in the ejection speed requires a longer time for ink droplets ejected from the print head to reach the print medium. Since the print medium P is conveyed for a longer distance in the corresponding time, the printing position (the landing position of the ink droplet) is displaced in the upstream side in the conveying direction for the corresponding distance. That is, the printing position is displaced in a direction opposite to the conveying direction of the print medium. The decrease in the ejection speed greatly depends on the type of ink, the production error of the print head, as well as driving conditions of the print head including a driving voltage of the printing apparatus. Therefore, it is difficult to accurately predict the decrease in the ejection speed only from the number of ink ejections.

FIG. 5A to FIG. 5E are diagrams explaining a method for correcting the printing position displacement (displacement of dot formation positions) caused by the decrease in the ejection speed.

Figures 5A, 5B, 5C, 5D, 5E:
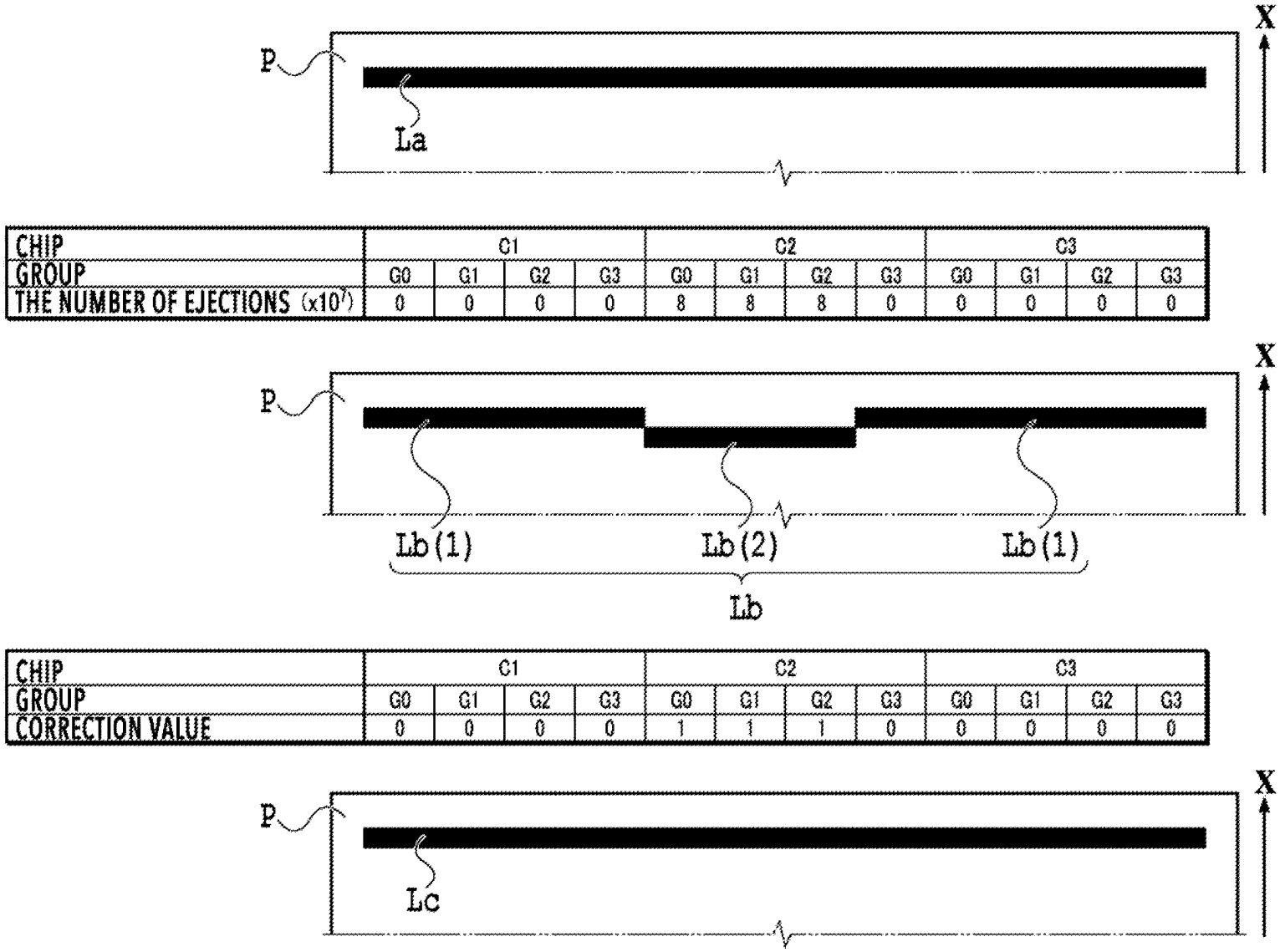
FIG. 5A, FIG. 5B, FIG. 5C, FIG. 5D, and FIG. 5E are diagrams explaining a method for correcting printing position displacement.

FIG. 5A is a diagram explaining a line (horizontal line) La printed on the print medium P that is conveyed in the arrow X direction at an early stage of the use of the print head. Since the nozzles in the chips C1, C2, C3 of the print head 5 have no difference in the ejection speed caused by a difference in use frequency, correction is not particularly needed to print the high-quality line La free from printing position displacement.

As shown in FIG. 5B, in a case where the number of ink ejections from the groups G0, G1, G2 in the chip C2 of the print head 5 is large, that is, in a case where the use frequency of these groups G0, G1, G2 is higher than that of the other groups, the line Lb is printed as shown in FIG. 5C. Since the ejection speed of the ink ejected from the groups G0, G1, G2 in the chip C2 having a high use frequency decreases, in the line Lb, the printing position of a portion Lb(2) corresponding to these groups is displaced in the upstream side in the conveying direction (the arrow X direction) as compared to the other portions Lb(1).

FIG. 5D is a diagram explaining a correction value for correcting the printing position displacement in the line Lb of FIG. 5C. In this example, a correction value of "1" for correcting an ink ejection timing is set for the groups G0, G1, G2 in the chip C2. The correction value is a correction value for advancing an ink ejection timing. In a case where the correction value is "1", the ink ejection timing is adjusted to an earlier timing by one pixel, and the printing position (dot formation position) is displaced by one pixel in the downstream side in the conveying direction. As a result, as shown in FIG. 5E, a line Lc in which the printing position displacement is corrected can be printed.

Figure 6A:
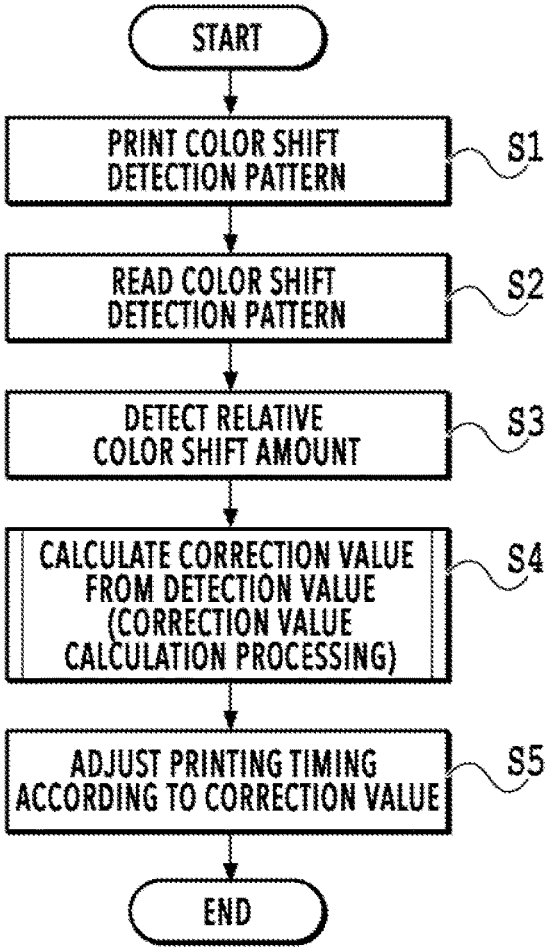
FIG. 6A is a flowchart for explaining correction processing of printing position displacement according to the first embodiment of the present invention.
Figure 6B:
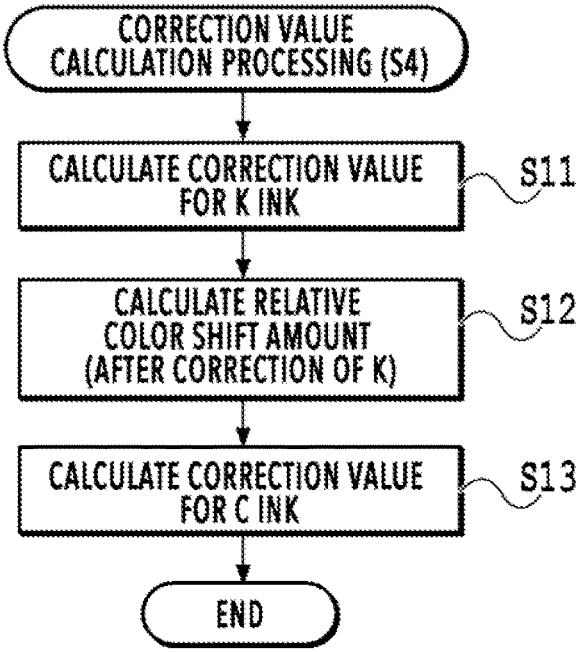
FIG. 6B is a flowchart for explaining correction value calculation processing in FIG. 6A.

FIG. 6A and FIG. 6B are flowcharts for explaining correction processing performed on the printing position displacement (color shift) for black ink (K ink) and cyan ink (C ink). FIG. 7A to FIG. 7C and FIG. 8A to FIG. 8D are diagrams specifically explaining the correction processing. The reference numeral "S" in FIG. 6A and FIG. 6B denotes a step in the flowchart.

Figures 7A, 7B, 7C:
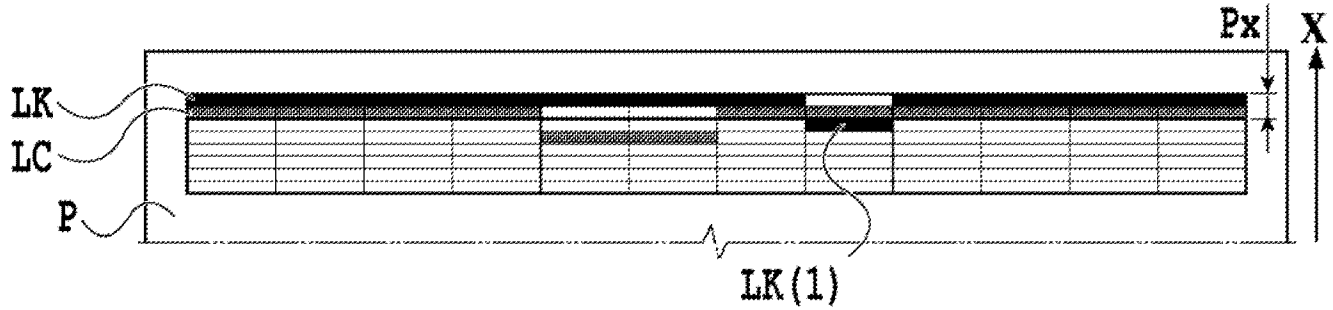
FIG. 7A, FIG. 7B, and FIG. 7C are diagrams explaining a method for detecting printing position displacement between two nozzle arrays.

First, the CPU 31 functions as a pattern printing control unit and prints, by using the print head 5, a line (horizontal line) on the print medium P as a color shift detection pattern (test pattern) for detecting the state of a color shift (S1). FIG. 7A is a diagram explaining the number of ejections of K ink and the number of ejections of C ink from the print head at that point. In this example, as for K ink, the group G3 in the chip C2 has the large number of ejections. Meanwhile, as for C ink, the groups G0, G1 in the chip C2 have the large number of ejections. FIG. 7B is a diagram explaining a printing result of a line (color shift detection pattern) printed by using the print head in which the nozzles have different use frequencies. The line LK (a reference pattern; a first pattern) is printed with K ink and the line LC (a nonreference pattern; a second pattern) is printed with C ink. In reality, the lines LK, LC are printed so as to overlap each other in the same position. However, for convenience in explaining, FIG. 7B shows that one pixel Px is divided into two parts in the conveying direction: the line LK is printed in a downstream part in the conveying direction and the line LC is printed in an upstream part in the conveying direction. The parts indicated by the lines LK, LC corresponding to the nozzles having a high use frequency are printed with displacement in the upstream side in the conveying direction.

Next, the CPU 31 reads the printed color shift detection pattern (the lines LK, LC) by using the scanner 6 (S2), and based on the read data, detects a relative color shift amount (a detection value) in the conveying direction regarding K ink and C ink (S3). FIG. 7C is a diagram explaining a relative color shift amount detected from the read data on the color shift detection pattern (the lines LK, LC) of FIG. 7B. In this example, in a case where the printing position (nonreference printing position) of the line LC is displaced from the printing position (reference printing position) of the line LK by one pixel in the upstream side in the conveying direction, the displacement amount is "+1". In a case where the printing position of the line LK is displaced from the printing position of the line LC by one pixel in the upstream side in the conveying direction, the displacement amount is "−1".

The reason for detecting the relative color shift amount as in this example will be described.

For example, as compared to 210 mm, which is the width of the A4 size print medium, the printing position displacement of a monochrome image is small, ranging from several tens to a hundred and tens of μm, and the production error of the scanner 6 and the moving error for the reading are about several tens of μm in the conveying direction. Furthermore, in a case where a reading resolution of the scanner 6 is 600 dpi, the size of one pixel is about 40 μm. For this reason, it is difficult to detect a displacement amount of several tens of μm or smaller in the conveying direction in each position of the print head in the width direction for a monochrome image made with K ink, C ink, or the like. Furthermore, in a case where a printing position displacement amount is detected for each chip, it is impossible to detect the printing position displacement occurring within the chip. Furthermore, in a case where a plurality of detection patterns corresponding to subdivided portions of the print head are printed and the detection patterns are read for analysis of the printing positions among the detection patterns, the analysis requires a long time.

Meanwhile, the detection of the relative color shift amount as in this example allows reading of the detection pattern for K ink and C ink by using the read pixel in substantially the same position in the scanner 6, and thus, the detection is hardly affected by the production error and the moving error of the scanner 6. Furthermore, the color shift detection pattern is printed while a printing timing between the two colors of ink is shifted, and change in a concentration of the detection pattern and pattern change are read. Accordingly, even if a reading resolution of the detection pattern is low, a relative position displacement amount between the printing positions for the color ink can be easily calculated. In addition, the printing position displacement occurs not only according to the number of ink ejections but also due to the change in the ink ejection speed caused by the production error of the print head and the driving conditions of the print head. As compared to the case of estimating the printing position displacement amount only from the number of ink ejections, printing the detection pattern and measuring the actual printing position displacement amount as described above allow more accurate detection of the printing position displacement amount.

Next, the CPU 31 calculates a correction value for each of the groups G0, G1, G2, G3 in the chips C1, C2, C3 for K ink and C ink based on a detection value of the relative color shift amount (S5). Then, the CPU 31 functions as an image printing control unit and adjusts a printing timing (ejection timings for K ink and C ink) according to the correction value (S6).

FIG. 6B is a flowchart for explaining correction value calculation processing (S4) in FIG. 6A.

Figures 8A, 8B, 8C, 8D:
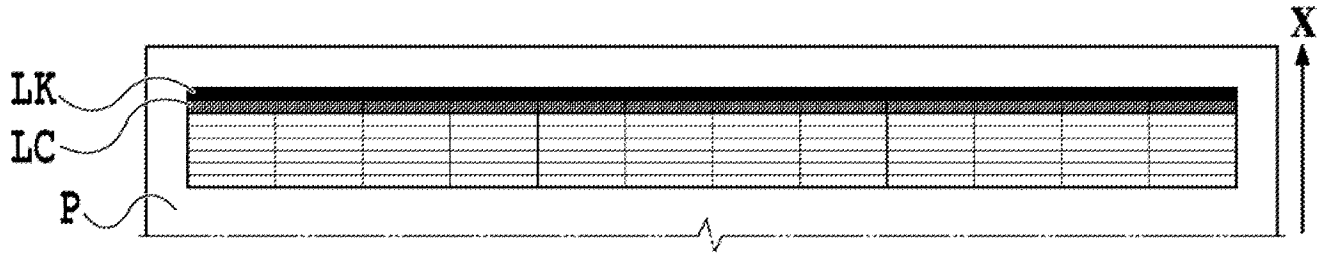
FIG. 8A, FIG. 8B, FIG. 8C, and FIG. 8D are diagrams explaining a method for correcting printing position displacement between two nozzle arrays.

The CPU 31 first calculates a correction value for each of the groups G0 to G3 for each of the chips C1 to C3 for K ink (S11). More specifically, as shown in FIG. 8A, for the portion LK(1) with a displacement amount of "−1" in the line LK of FIG. 7B, a correction value of "1" is calculated based on the relative color shift amount of FIG. 7C. That is, a correction value of the group G3 in the chip C2 corresponding to the portion LK(1) with a displacement amount of "−1" is set at "1". Next, as shown in FIG. 8B, the CPU 31 uses the correction value for K ink and the relative color shift amount (the detection value) to calculate a relative color shift amount (after the correction of K) after the correction based on the correction value for K ink (S12). More specifically, the relative color shift amount (after the correction of K) can be obtained by combining the relative color shift amount (the detection value) and the correction value for K ink. Accordingly, the relative color shift amount (after the correction of K) can be obtained without the need of a work of printing and reading the detection pattern again after adjusting the printing timing based on the correction value for K ink.

Next, the CPU 31 calculates a correction value for C ink (S13). More specifically, for the groups G0, G1 in the chip C2 with a relative color shift amount of "+1", since the printing position of C ink is displaced by one pixel in the upstream side in the conveying direction, the correction value is set at "1" as shown in FIG. 8C. FIG. 8D shows a printing result of the lines LK, LC after correcting the printing position displacement based on the correction values for K ink and C ink. The printing position of the portion printed with displacement in the upstream side in the conveying direction is corrected to a normal position in the downstream side in the conveying direction.

(Color Shift Detection Pattern)

Figure 9A:
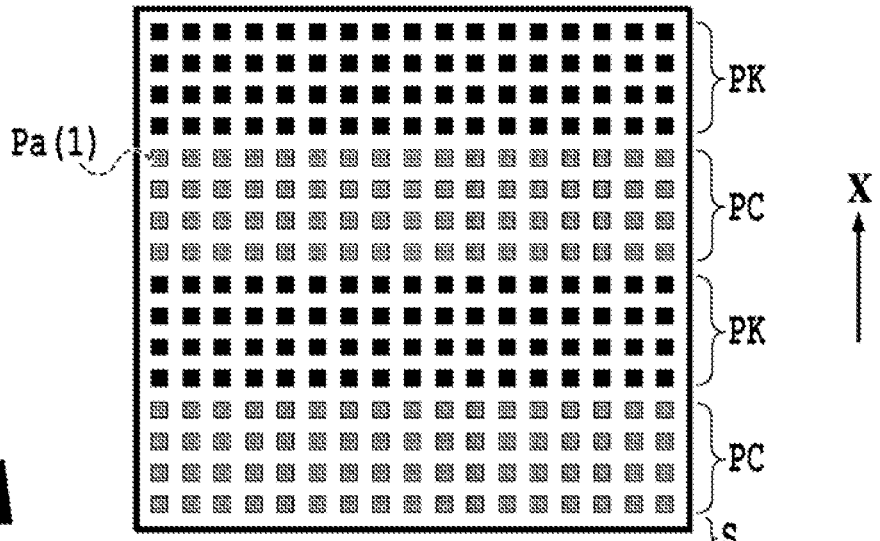
FIG. 9A, FIG. 9B, and FIG. 9C are diagrams explaining detection patterns of printing position displacement between two nozzle arrays.
Figure 9B:
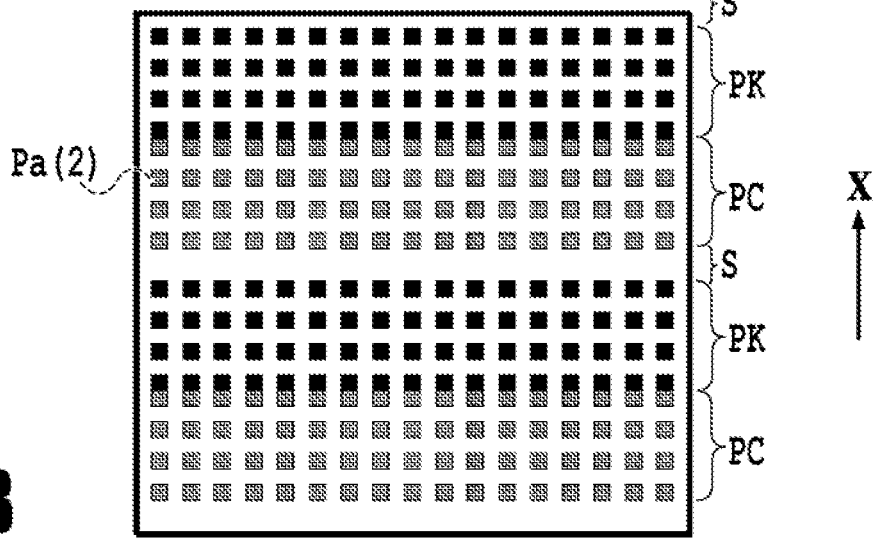
Figure 9C:
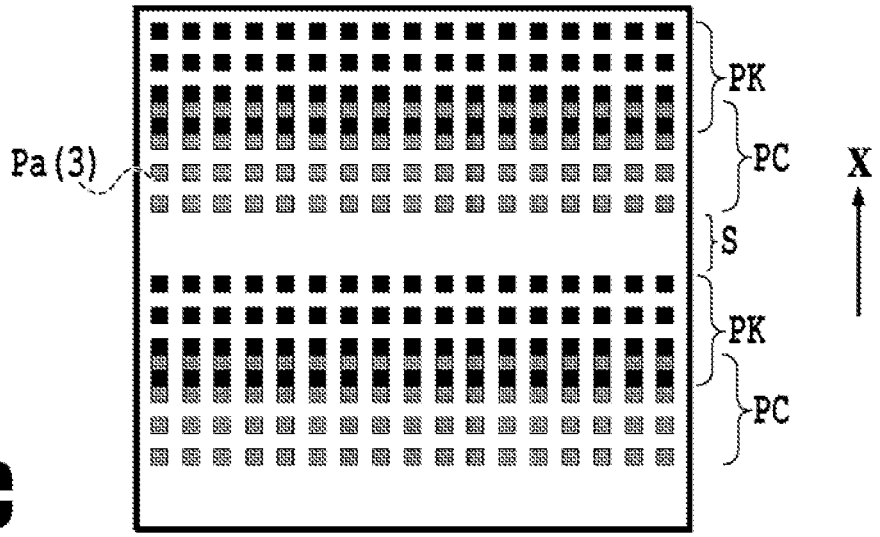

FIG. 9A to FIG. 9C are diagrams explaining color shift detection patterns according to the present embodiment.

FIG. 9A shows a detection pattern Pa(1) printed in a case where there is no color shift between K ink and C ink. The horizontal direction in FIG. 9A corresponds to the nozzle array direction of the print head. Preferably, a pattern portion PK for K ink is printed by using the nozzle array L1 of FIG. 2B and a pattern portion PC for C ink is printed by using the nozzle array L3 of FIG. 2B. The reason is that printing position displacement may occur due to a shift in an ink ejection direction for each nozzle array, and to print a detection pattern, it is preferable to use the nozzle arrays having the same nozzle arrangement form like the nozzle arrays L1, L3 and having the same characteristic. In addition, to more accurately detect a color shift between the nozzle arrays, it is preferable to print a detection pattern not only for detecting printing position displacement between the nozzle arrays L1, L3 but also for detecting printing position displacement between the nozzle arrays L1, L2, between the nozzle arrays L3, L4, and between the nozzle arrays L2, L4.

In the present embodiment, printing position displacement in a case where an ink ejection speed decreases as the number of use of the print head increases is corrected. In this case, in allocating print data to a plurality of nozzle arrays corresponding to the same color of ink, the print data is allocated such that the nozzle arrays have substantially the same use frequency, whereby each of the nozzle arrays has substantially the same amount of printing position displacement. Accordingly, in the present embodiment, only a detection pattern for detecting printing position displacement between the nozzle arrays L1, L3 is printed.

FIG. 9B shows a detection pattern Pa(2) in a case where a printing position of the pattern portion PK and a printing position of the pattern portion PC are relatively displaced by one pixel in the conveying direction. FIG. 9C shows a detection pattern Pa(3) in a case where printing positions of the pattern portions are relatively displaced by three pixels in the conveying direction. In a case where the printing positions of the pattern portions PK, PC are relatively displaced, a space S is formed in a boundary portion therebetween, and the lightness of the space S is equal to that of the print medium itself. Accordingly, in a case where the lightness of the detection pattern is detected, since the size of the space S increases as the displacement between the pattern portions PK, PC increases and the lightness of the entire detection pattern comes closer to the lightness of the print medium itself, it is possible to detect a printing position displacement amount in accordance with the lightness. Furthermore, by directly detecting the size of the space S, it is also possible to detect a printing position displacement amount.

Figure 10:
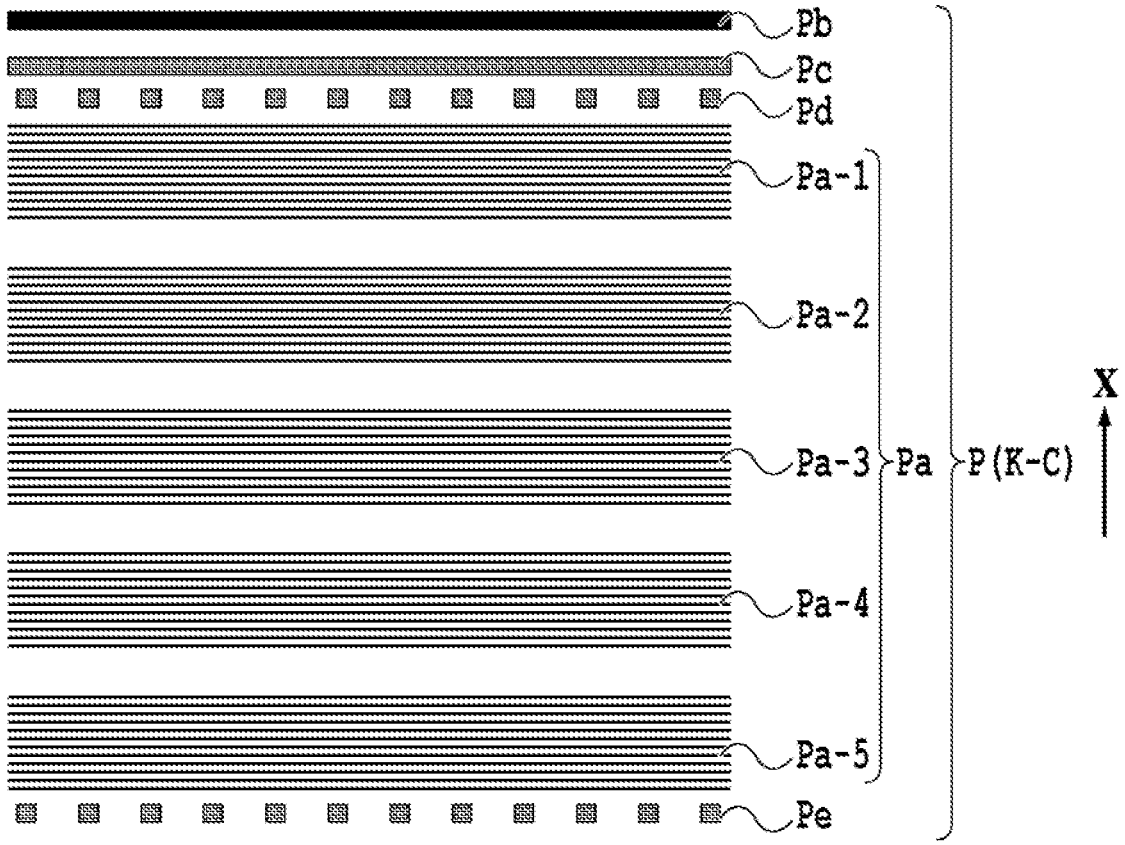
FIG. 10 is a diagram explaining a detection pattern for printing position displacement between two nozzle arrays.

FIG. 10 is a diagram explaining a color shift detection pattern between K-C (between K ink and C ink) combining a plurality of detection patterns including the color shift detection patterns Pa of FIG. 9A to FIG. 9C. The horizontal direction in FIG. 9A to FIG. 9C corresponds to the nozzle array direction of the print head. The pattern Pb is a pattern printed only with K ink. The pattern Pc is a pattern printed only with C ink. In the inkjet print head, in a case where a time interval between ink ejections increases, ink in the nozzles may be dry and printing position displacement (displacement of ink landing positions) may occur. Depending on the color shift detection pattern Pa, printing position displacement that is small enough to be ignored in normal use may be detected, and thus the patterns Pb, Pc are printed for preliminarily ejecting ink from the nozzles immediately before printing the detection pattern Pa.

The pattern Pd is a pattern for detecting the positions of the used nozzles. Since the scanner 6 or the like for reading the color shift detection pattern Pa has a reading error to some extent within its reading width, with only the color shift detection pattern Pa, it is difficult to accurately determine the nozzle positions. Then, in this example, the pattern Pd for specifying the nozzle positions is printed. By comparing information about the positions of the nozzles to be used for printing the pattern Pd with the read data on the pattern Pd, it is possible to associate the read image of the color shift detection pattern Pa and the nozzle numbers 0 to 31. The pattern Pd is printed with at least one of K ink and C ink.

In this example, the color shift detection pattern Pa between K ink and C ink is printed five times (detection patterns Pa-1 to Pa-5). The detection pattern Pa-3 in the middle is printed such that the printing position of K ink and the printing position of C ink are not displaced from each other in the conveying direction on the print data. The detection pattern Pa-2 is printed such that the printing position of C ink is displaced from the printing position of K ink in the conveying direction by "+1" pixel. The detection pattern Pa-1 is printed such that the printing position of C ink is displaced from the printing position of K ink in the conveying direction by "+2" pixel. Further, the detection pattern Pa-4 is printed such that the printing position of C ink is displaced from the printing position of K ink in the conveying direction by "−1" pixel. The detection pattern Pa-5 is printed such that the printing position of C ink is displaced from the printing position of K ink in the conveying direction by "−2" pixel. In this manner, the detection patterns Pa-1 to Pa-5 are printed in which the printing position of K ink and the printing position of C ink are sequentially displaced from each other on the print data, and the printing result is read. From the read result, it is possible to determine the level of an actual relative color shift amount and the level of displacement of the print data for correcting the relative color shift amount (the level of a shift in ink ejection timing).

The pattern Pe is a pattern for detecting the positions of the used nozzles like the pattern Pd. In this example, before or after printing the color shift detection pattern Pa, the patterns Pd, Pe for detecting the positions of the used nozzles are printed. As a result, it is possible to detect winding and inclination of the print medium, if any, in printing and reading the pattern P(K-C) for color shift detection between K-C. By reflecting the detection result, it is possible to more accurately determine the positions of the nozzles.

By reading the printing result of the detection pattern P(K-C), it is possible to detect a relative color shift amount between two colors (between K-C) in each of the nozzle positions of the print head. The printing position (ink landing position) in each nozzle position of the print head changes depending on the variations in the use frequency of the nozzles. In the present embodiment, a detection pattern is printed by the nozzles ejecting two colors of ink in the same position in the conveying direction, and the detection pattern printed in the same position is read based on substantially the same reading pixel of the scanner 6. Then, a printing position displacement amount for two colors of ink is analyzed. Accordingly, it is possible to reliably detect printing position displacement caused by the variations in the use frequency of the nozzles in the print head. In the present embodiment, like the printing position displacement amount for two colors of ink, it is also possible to detect, for example, a printing position displacement amount for the same color of ink ejected from two nozzles in different nozzle arrays.

Second Embodiment

In the present embodiment, four colors of ink, K, C, M, Y, are used to correct a color shift among them. The printing area and the reading area of the color shift detection pattern are smaller than the entire width of the print head. More specifically, in a case where the width of the print medium on which a color shift detection pattern is printed is smaller than the entire width of the print head, it is assumed that, for example, a readable width of the scanner 6 is smaller than the entire width of the print head. The processing such as printing and reading of the detection pattern in the present embodiment is the same as that of FIG. 6A in the embodiment already described.

FIG. 11 to FIG. 13E are a flowchart and diagrams specifically explaining color shift correction processing.

FIG. 12A is a diagram explaining the number of ejections of K, C, M, Y inks from the print head at a point when a color shift detection pattern is printed. FIG. 12B is a diagram explaining a printing result of lines (color shift detection patterns) printed by using the print head having different use frequencies of the nozzles. The line LK is printed with K ink; the line LC is printed with C ink; the line LM is printed with M ink; and the line LY is printed with Y ink. In reality, the lines LK, LC, LM, LY are printed so as to overlap each other in the same position. However, for convenience in explaining, FIG. 12B shows that a pixel Px is divided into four parts in the conveying direction and the lines LK, LC, LM, LY are printed in the order from the downstream side in the conveying direction. The parts indicated by the lines corresponding to the nozzles having a high use frequency are printed with displacement in the upstream side in the conveying direction.

FIG. 12C is a diagram explaining a color shift amount detected from the read data on the color shift detection pattern of FIG. 12B. In this example, an area in which a color shift amount can be detected is an area R0 from the group G2 in the chip C1 to the group G1 in the chip C3, and then as a color shift amount, a relative printing position displacement amount is detected between "K-C", between "K-M", and between "K-Y". In a case where the printing position of the lines LC, LM, LY is displaced from the printing position of the line LK by one pixel in the upstream side in the conveying direction, a displacement amount is "+1"; in a case where the position of the line LK is displaced from the position of the lines LC, LM, LY by one pixel in the upstream side in the conveying direction, a displacement amount is "−1".

Figure 11:
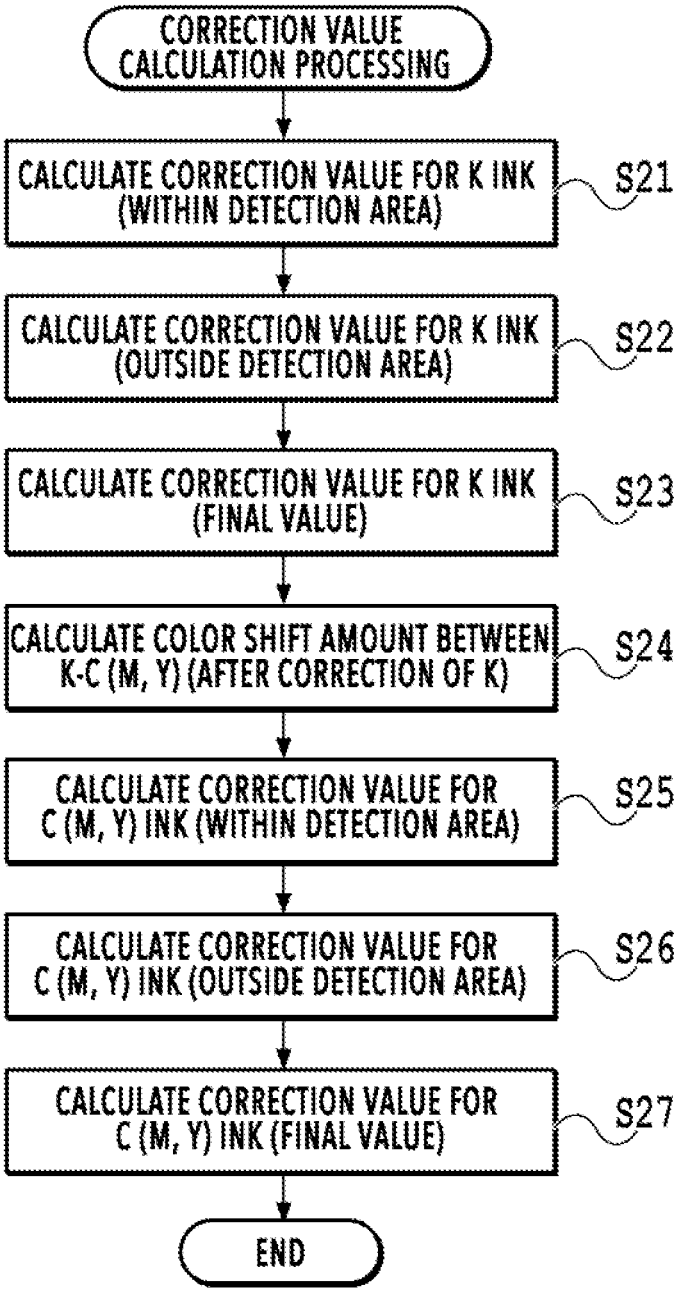
FIG. 11 is a flowchart for explaining correction value calculation processing according to a second embodiment of the present invention.

FIG. 11 is a flowchart for explaining correction value correction processing (corresponding to S4 in FIG. 6A) in the present embodiment.

The CPU 31 first calculates a correction value for K ink (within the detection area) in the detection area R0 (see FIG. 12C) (S21). More specifically, in each of the same printing position, a minimum value of the displacement amounts between K-C, between K-M, and between K-Y is determined. In a case where the minimum value is negative, a correction value for K ink corresponding to the printing position is calculated. The minimum value corresponds to a maximum value of the displacement amounts of the line LK with respect to the lines LC, LM, LY in the upstream side in the conveying direction. FIG. 13A is a diagram explaining a correction value for K ink calculated from the color shift amounts of FIG. 12C. For example, the displacement amounts between K-C, between K-M, and between K-Y of the group G3 in the chip C1 for K ink are expressed by 0, 0, 1 ([K-C, K-M, K-Y]=[0, 0, 1]), which does not include a negative value, and thus a correction value for K ink in the group G3 is "0". Furthermore, since the displacement amounts between K-C, between K-M, and between K-Y of the groups G0, G3 in the chip C2 for K ink include a negative value "−1", a correction value for K ink of the groups is "1". Another example of the calculation method of a correction value for K ink is to obtain a correction value based on a value which becomes "0" when combined with a minimum value of the displacement amounts between K-C, between K-M, and between K-Y. Still another example of the calculation method is to determine necessity of the correction of the printing position of K ink based on a sign and a magnitude of an absolute value of the displacement amounts between K-C, between K-M, and between K-Y, and obtain a correction value "1" only if the correction is determined to be needed.

Next, the CPU 31 calculates a correction value for K ink (outside the detection area) in the areas R1, R2 (see FIG. 12C) other than the detection area R0 (S22). Since a detection value of the displacement amount between colors cannot be obtained for these areas R1, R2, in this example, "1" is set as the correction value for K ink in a case where the number of K ink ejections is equal to or greater than a predetermined number. In FIG. 12A, since the number of ink ejections from the group G3 in the chip C3 for K ink is large, a correction value for the group is set at "1".

Next, the CPU 31 calculates a final correction value (final value) for K ink based on the correction value for K ink (within the detection area) and the correction value for K ink (outside the detection area) (S23). In this example, based on the logical OR between the correction value for K ink (within the detection area) and the correction value for K ink (outside the detection area), a correction value (final value) is calculated.

In this example, information about the number of ink ejections is used for calculating a correction value (outside the detection area). However, in a case where a production error and driving conditions of the print head have a greater impact as compared to a detection error in a color shift amount, the information about the number of ink ejections may be referred to in calculating a correction value (within the detection area). For example, only in a case where a color shift amount is equal to or smaller than "−1" and the number of ejected dots is "$8\times10^7$" or greater, "1" may be set as the correction value for K ink.

Next, the CPU 31 reflects the correction value for K ink (the final value) of FIG. 13A on the detection values of the color shift amounts of FIG. 12C and calculates relative color shift amounts (after the correction of K) between K-C, between K-M, and between K-Y (S24). More specifically, as shown in FIG. 13B, a relative color shift amount (after the correction of K) between K-C is obtained by the sum of the color shift amount (the detection value) between K-C in FIG. 12C and the correction value for K ink (the final value) in FIG. 13A. In the same manner, relative color shift amounts (after the correction of K) between K-M and between K-Y are also calculated.

Next, the CPU 31 uses the relative color shift amounts (after the correction of K) between K-C, between K-M, and between K-Y and calculates correction values for C, M, Y inks (within the detection area) in the detection area R0 (S25). More specifically, as shown in FIG. 13C, the correction value for C ink (within the detection area) is obtained as a value corresponding to a color shift amount (a detection value) between K-C in FIG. 13B. Correction values for M and Y inks (within the detection area) are also obtained. Next, like the correction value for K ink (outside the detection area), the CPU 31 obtains correction values for C, M, Y inks (outside the detection area) in the areas R1, R2 based on the number of ink ejections (S26). Then, the CPU 31 combines the correction values for C, M, Y inks (within the detection area) and the correction values for C, M, Y inks (outside the detection area), respectively, and calculates correction values for C, M, Y inks (final values) (S27). In this manner, the CPU 31 calculates a correction value of printing position displacement for each of the lines LC, LM, LY (for each nonreference printing position). FIG. 13D shows a calculation result of the correction values for K, C, M, Y inks (the final values) and FIG. 13E shows a printing result of the lines LK, LC after correcting the printing position displacement based on the correction values (the final values).

(Color Shift Detection Pattern)

Figure 14:
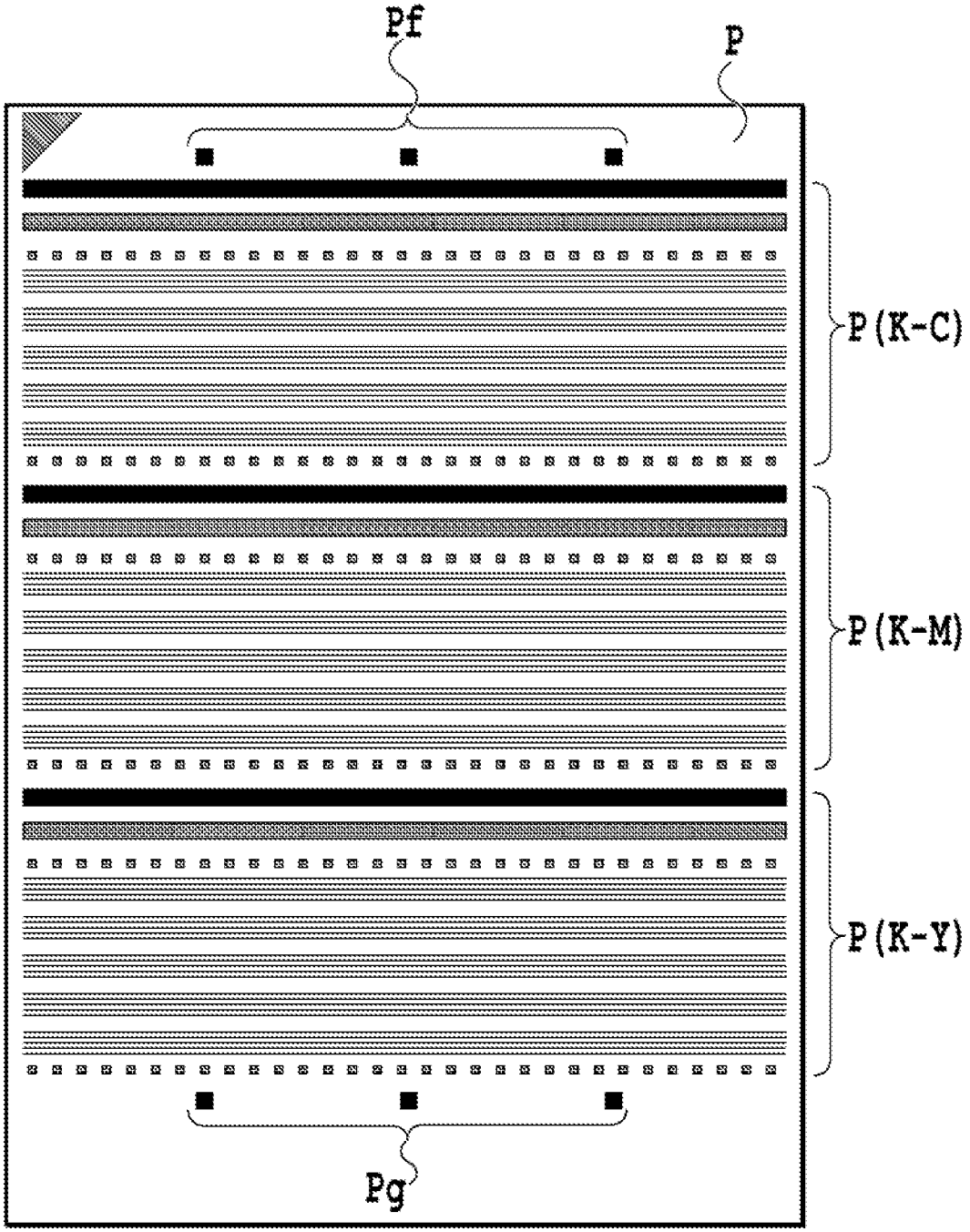
FIG. 14 is a diagram explaining a detection pattern for printing position displacement among four nozzle arrays.

In the present embodiment, as shown in FIG. 14, in addition to the detection pattern P(K-C) of FIG. 10 already described in the first embodiment, a color shift detection pattern P(K-M) between K-M and a color shift detection pattern P(K-Y) between K-Y are printed like the detection pattern P(K-C). Patterns Pf, Pg are assisting patterns for detecting positions and inclinations of the detection patterns P(K-C), P(K-M), P(K-Y) in reading them and may be printed with any of K ink, C ink, M ink, and Y ink.

OTHER EMBODIMENTS

At an early stage of the use of a print head and a stage where the number of ink ejections is equal to or less than a predetermined number with small printing position displacement, the method disclosed in Japanese Patent Laid-Open No. 2012-35477 is effective. In these stages, like Japanese Patent Laid-Open No. 2012-35477, a displacement amount from an ideal ink landing position can be calculated based on a relative positional relation among a plurality of patterns printed on a print medium and the ink landing position can be corrected based on the displacement amount. At the stages where the method of Japanese Patent Laid-Open No. 2012-35477 is effective, the printing position displacement may be corrected by using the method disclosed in Japanese Patent Laid-Open No. 2012-35477 and, after the number of ink ejections exceeds a predetermined number, the printing position displacement may be corrected by using the method of the present invention. Furthermore, at an early stage where the number of ink ejections is equal to or less than a predetermined number, as disclosed in Japanese Patent Laid-Open No. 2012-35477, displacement among a plurality of chips of the print head may be corrected, and, after the number of ink ejections exceeds a predetermined number, the printing position displacement among the chips may be corrected by using the method of the present invention. In this case, in addition to the detection patterns of printing position displacement (color shift) among a plurality of arrays ejecting different types of ink, a detection pattern of printing position displacement among the chips of the print head may be printed and the reading processing may be performed on the result. A printing result of the detection pattern may be read by a reading device or may be read by a user.

Furthermore, printing position displacement caused by variations in an ink ejection speed is affected by a conveying speed of a print medium and a distance between the print head and the print medium P. For this reason, the present invention may be applied only to a case where a conveying speed of the print medium has increased and to a case where a distance between the print head and the print medium has increased. In addition, an allowable printing position displacement amount may be different depending on the type and use of print medium. Accordingly, the present invention may be applied to some printing modes among a plurality of printing modes that are set in accordance with the type, use, and printing quality of print medium.

In the above-described embodiments, the nozzle array ejecting K ink is specified as a reference side nozzle array and the nozzle arrays ejecting C, M, Y inks are specified as nonreference side nozzle arrays, and a relative printing position displacement amount thereamong is detected. However, the reference side nozzle array is not limited to the nozzle array for K ink. Any nozzle array may be the reference side nozzle array. Furthermore, to detect a relative color shift amount, the number of colors of ink used may be two or greater. Further, of the plurality of colors of ink used in a printing apparatus, the use of color ink having a great impact of a printing position displacement amount and blur may be limited to correct the printing position displacement.

In the above-described embodiments, the printing positions among a plurality of colors of ink are adjusted. However, the present invention may be applicable also to a case where printing position displacement occurs because the number of ink ejections is imbalanced among a plurality of nozzle arrays printing the same pixel with the same color of ink. Furthermore, the present invention may be applied, for example, to correct the printing position displacement among nozzle arrays ejecting two different types of K ink.

The present invention may be realized in the processing of providing a program for implementing one or more functions of the above-described embodiments for a system or an apparatus via a network or a storage medium and causing one or more processers in a computer of the system or the apparatus to read and execute the program. Furthermore, the present invention may be realized also by a circuit (e.g., ASIC) for implementing one or more functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-164781, filed Sep. 3, 2018, which is hereby incorporated by reference wherein in its entirety.

What is claimed is:

1. An inkjet printing apparatus comprising:

a movement unit configured to perform a relative movement between a print medium and a print head in a first direction, wherein the print head is provided with a reference side nozzle array and a plurality of nonreference side nozzle arrays, each nozzle array being provided with a plurality of nozzles that are capable of ejecting ink and that are arrayed in a second direction crossing the first direction, and wherein the print head ejects ink from the reference side nozzle array and the nonreference side nozzle arrays during the relative movement;

a pattern printing control unit configured to cause the print head to print a reference pattern printed by the reference side nozzle array and a nonreference pattern printed by each of the plurality of nonreference side nozzle arrays, according to pattern data;

a detecting unit configured to (1) detect a reference relative position displacement amount between (a) a reference printed position of a part of the reference pattern printed using a reference predetermined range of the reference side nozzle array, the reference predetermined range extending in an intersection direction intersecting the first direction and (b) a nonreference printed position of a part of the nonreference patterns printed using a part of the nonreference side nozzle arrays corresponding to the reference predetermined range, the part extending in the intersection direction, and (2) detect a nonreference relative position displacement amount between (a) a reference printed position of a part of the reference pattern printed using a nonreference predetermined range of the reference side nozzle array, the nonreference predetermined range extending in the intersection direction and being different from the reference predetermined range, and (b) a nonreference printed position of a part of the nonreference pattern printed using a part of the nonreference side nozzle arrays corresponding to the nonreference predetermined range, the part extending in the intersection direction;

a determining unit, in a case where (a) the part of the reference pattern printed by the reference predetermined range of the reference side nozzle array is printed at an upstream side in the first direction with respect to the part of the nonreference pattern printed by the part of the nonreference side nozzle arrays corresponding to the reference predetermined range and (b) the part of the nonreference pattern printed by the part of the nonreference side nozzle arrays corresponding to the nonreference predetermined range is printed at an upstream side in the first direction with respect to the part of the reference pattern printed by the nonreference predetermined range of the reference side nozzle array, configured to (1) determine a first correction value for correcting a printing position on the print medium to be printed by the reference predetermined range of the reference side nozzle array in accordance with (a) a printing position on the print medium to be printed by the part of the nonreference side nozzle arrays corresponding to the reference predetermined range and (b) the reference relative position displacement amount detected by the detecting unit, in a case where a second pattern printed by a nonreference side nozzle array of the nonreference side nozzle arrays is printed with respect to a first pattern printed by the reference side nozzle array in the first direction, and (2) determine a second correction value for correcting a printing position on the print medium to be printed by the part of the nonreference side nozzle arrays corresponding to the nonreference predetermined range in accordance with (a) a printing position on the print medium to be printed by the nonreference predetermined range of the reference side nozzle array and (b) the nonreference relative position displacement amount; and an image printing control unit configured to print an image on the print medium by controlling the print head to (a) correct a printing position on the print medium to be printed by the reference predetermined range of the reference side nozzle array according to the first correction value and (b) to correct a printing position on the print medium to be printed by the part of the nonreference side nozzle arrays corresponding to the nonreference predetermined range according to the second correction value.

2. The inkjet printing apparatus according to claim 1, further comprising a reading unit configured to read the reference pattern and each of the nonreference patterns printed on the print medium.

3. The inkjet printing apparatus according to claim 1, wherein the reference side nozzle array and the plurality of nonreference side nozzle arrays are each divided into a plurality of blocks in the second direction, wherein the detecting unit detects the relative position displacement amount for each of portions of the reference pattern and the nonreference patterns corresponding to the plurality of blocks, and wherein the first and second calculating units calculate the first and second correction values for each of the portions.

4. The inkjet printing apparatus according to claim 1, wherein the nozzles have a greater displacement amount of a printing position in the opposite direction depending on a use frequency of the nozzles.

5. The inkjet printing apparatus according to claim 1, wherein ink ejected from at least two of the reference side nozzle array and the plurality of nonreference side nozzle arrays is different colors of ink.

6. The inkjet printing apparatus according to claim 1, wherein the pattern printing control unit prints the reference pattern and the nonreference pattern in a case where a number of ink ejections from the nozzles in each of the reference side nozzle array and the plurality of nonreference side nozzle arrays is equal to or greater than a predetermined number.

7. The inkjet printing apparatus according to claim 2, further comprising a third calculating unit configured to calculate the first and second correction values based on the number of ink ejections from the nozzles as for the nozzles corresponding to an outside of a reading area of the reading unit.

8. An inkjet printing apparatus comprising:

a movement unit configured to perform a relative movement between a print medium and a print head in a first direction, wherein the print head is provided with a first nozzle array and a second nozzle array, each nozzle array being provided with a plurality of nozzles that are capable of ejecting ink and that are arrayed in a second direction crossing the first direction, and wherein the print head ejects ink from the first nozzle array and the second nozzle array during the relative movement;

a pattern printing control unit configured to cause the print head to print a first pattern printed by the first nozzle array and a second pattern printed by the second nozzle array, according to pattern data;

a detecting unit configured to (1) detect a first relative position displacement amount between (a) a first printed position of a part of the first pattern printed using a first predetermined range of the first nozzle array, the first predetermined range extending in an intersection direction intersecting the first direction and (b) a second printed position of a part of the second pattern printed using a part of the second nozzle array corresponding to the first predetermined range, the part extending in the intersection direction, and (2) detect a second relative position displacement amount between (a) a first printed position of a part of the first pattern printed using a second predetermined range of the first nozzle array, the second predetermined range extending in the intersection direction and being different from the first predetermined range, and (b) a second printed position of a part of the second pattern printed using a part of the second nozzle array corresponding to the second predetermined range, the part extending in the intersection direction;

a determining unit, in a case where (a) the part of the first pattern printed by the first predetermined range of the first nozzle array is printed at an upstream side in the first direction with respect to the part of the second pattern printed by the part of the second nozzle array corresponding to the first predetermined range and (b) the part of the second pattern printed by the part of the second nozzle array corresponding to the second predetermined range is printed at an upstream side in the first direction with respect to the part of the first pattern printed by the second predetermined range of the first nozzle array, configured to (1) determine a first correction value for correcting a printing position on the print medium to be printed by the first predetermined range of the first nozzle array in accordance with (a) a printing position on the print medium to be printed by the part of the second nozzle array corresponding to the first predetermined range and (b) the first relative position displacement amount detected by the detecting unit, and (2) determine a second correction value for correcting a printing position on the print medium to be printed by the part of the second nozzle array corresponding to the second predetermined range in accordance with (a) a printing position on the print medium to be printed by the second predetermined range of the first nozzle array and (b) the second relative position displacement amount; and an image printing control unit configured to print an image on the print medium by controlling the print head (a) to correct a printing position on the print medium to be printed by the first predetermined range of the first nozzle array according to the first correction value and (b) to correct a printing position on the print medium to be printed by the part of the second nozzle array corresponding to the second predetermined range according to the second correction value.

9. The inkjet printing apparatus according to claim 8, further comprising a reading unit configured to read the first and second patterns printed on the print medium.

10. An inkjet printing method comprising:

a movement step of causing a relative movement between a print medium and a print head in a first direction;

a pattern printing control step of controlling the print head, the print head being provided with a reference side nozzle array and a plurality of nonreference side nozzle arrays, each nozzle array being provided with a plurality of nozzles that are capable of ejecting ink and that are arrayed in a second direction crossing the first direction, and wherein the print head ejects ink from the reference side nozzle array and the nonreference side nozzle arrays during the relative movement, to print a reference pattern printed by the reference side nozzle array and a nonreference pattern printed by each of the plurality of nonreference side nozzle arrays, according to pattern data;

a detecting step of (1) detecting a reference relative position displacement amount between (a) a reference printed position of a part of the reference pattern printed using a reference predetermined range of the reference side nozzle array, the reference predetermined range extending in an intersection direction intersecting the first direction and (b) a nonreference printed position of a part of the nonreference patterns printed using a part of the nonreference side nozzle arrays corresponding to the reference predetermined range, the part extending in the intersection direction, and (2) detecting a nonreference relative position displacement amount between (a) a reference printed position of a part of the reference pattern printed using a nonreference predetermined range of the reference side nozzle array, the nonreference predetermined range extending in the intersection direction and being different from the reference predetermined range and (b) a nonreference printed position of a part of the nonreference pattern printed using a part of the nonreference side nozzle arrays corresponding to the nonreference predetermined range, the part extending in the intersection direction;

a determining step of, in a case where (a) the part of the reference pattern printed by the reference predetermined range of the reference side nozzle array is printed at an upstream side in the first direction with respect to the part of the nonreference pattern printed by the part of the nonreference side nozzle arrays corresponding to the reference predetermined range and (b) the part of the nonreference pattern printed by the part of the nonreference side nozzle arrays corresponding to the nonreference predetermined range is printed at an upstream side in the first direction with respect to the part of the reference pattern printed by the nonreference predetermined range of the reference side nozzle array, (1) determining a first correction value for correcting a printing position on the print medium to be printed by the reference predetermined range of the reference side nozzle array in accordance with (a) a printing position on the print medium to be printed by the part of the nonreference side nozzle array of the plurality of nonreference side nozzle arrays corresponding to the reference predetermined range and (b) the reference relative position displacement amount detected by the detecting step, and (2) determining a second correction value for correcting a printing position on the print medium to be printed by the part of the nonreference side nozzle arrays corresponding to the nonreference predetermined range in accordance with (a) a printing position on the print medium to be printed by the nonreference predetermined range of the reference side nozzle array and (b) the nonreference relative position displacement amount and an image printing control step of printing an image on the print medium by controlling the print head (a) to correct a printing position on the print medium to be printed by the reference predetermined range of the reference side nozzle array according to the first correction value and (b) to correct a printing position on the print medium to be printed by the part of the nonreference side nozzle arrays corresponding to the nonreference predetermined range according to the second correction value.

11. A non-transitory computer-readable storage medium having stored therein a program for causing a computer to execute an inkjet printing method, the inkjet printing method comprising:

a movement step of causing a relative movement between a print medium and a print head in a first direction;

a pattern printing control step of causing the print head, which is provided with a first nozzle array and a second nozzle array, each nozzle array being provided with a plurality of nozzles that are capable of ejecting ink and that are arrayed in a second direction crossing the first direction, and wherein the print head ejects ink from the first nozzle array and the second nozzle array during the relative movement, to print a first pattern printed by the first nozzle array and a second pattern printed by the second nozzle array, according to pattern data;

a detecting step of (1) detecting a first relative position displacement amount between (a) a first printed position of a part of the first pattern printed using a first predetermined range of the first nozzle array, the first predetermined range extending in an intersection direction intersecting the first direction and (b) a second printed position of a part of the second pattern printed using a part of the second nozzle array corresponding to the first predetermined range, the part extending in the intersection direction, and (2) detecting a second relative position displacement amount between (a) a first printed position of a part of the first pattern printed using the first nozzle array within a second predetermined range of the first nozzle array, the second predetermined range extending in the intersection direction and being different from the first predetermined range and (b) a second printed position of a part of the second pattern printed using a part of the second nozzle array corresponding to the second predetermined range, the part extending in the intersection direction;

a determining step, in a case where (a) the part of the first pattern printed by the first predetermined range of the first nozzle array is printed at an upstream side in the first direction with respect to the part of the second pattern printed by the part of the second nozzle array corresponding to the first predetermined range and (b) the part of the second pattern printed by the part of the second nozzle array corresponding to the second predetermined range is printed at an upstream side in the first direction with respect to the part of the first pattern printed by the second predetermined range of the first nozzle array, of (1) determining a first correction value for correcting the printing position on the print medium to be printed by the first predetermined range of the first nozzle array in accordance with (a) the printing position on the print medium to be printed by the part of the second nozzle array corresponding to the first predetermined range and (b) the first relative position displacement amount detected by the detecting step, and (2) determining a second correction value for correcting a printing position on the print medium to be printed by the part of the second nozzle array corresponding to the second predetermined range in accordance with (a) a printing position on the print medium to be printed by the second predetermined range of the first nozzle array and (b) the second relative position displacement amount; and an image printing control step of printing an image on the print medium by controlling the print head (a) to correct a printing position on the print medium to be printed by the first predetermined range of the first nozzle array according to the first correction value and (b) to correct a printing position to be printed on the print medium by the part of the second nozzle array corresponding to the second predetermined range according to the second correction value.

12. The inkjet printing apparatus according to claim 8, wherein the first nozzle array and the second nozzle array are each divided into a plurality of blocks in the second direction, wherein the detecting unit detects the relative position displacement amount for each of portions of the first pattern and the second pattern corresponding to the plurality of blocks, and wherein the first and second calculating units calculate the first and second correction values for each of the portions.

13. The inkjet printing apparatus according to claim 8, wherein the nozzles have a greater displacement amount of a printing position at an opposite side to the direction in which the print medium advances at the position where printing is performed on the print medium depending on a use frequency of the nozzles.

14. The inkjet printing apparatus according to claim 8, wherein the print head is provided with a plurality of the second nozzle arrays, and wherein ink ejected from at least two of the first nozzle array and the plurality of the second nozzle arrays is different colors of ink.

15. The inkjet printing apparatus according to claim 14, wherein the pattern printing control unit prints the first pattern and the second pattern in a case where a number of ink ejections from the nozzles in each of the first nozzle array and the plurality of second nozzle arrays is equal to or greater than a predetermined number.

16. The inkjet printing apparatus according to claim 9, further comprising a third calculating unit configured to calculate the first and second correction values based on the number of ink ejections from the nozzles as for the nozzles corresponding to an outside of a reading area of the reading unit.

17. The inkjet printing apparatus according to claim 8, wherein the second calculating unit calculates the second correction value to correct the printing position on the print medium by the second nozzle array, by adding the relative position displacement amount of the printing position on the print medium by the second nozzle array to the first correction value of the printing position on the print medium by the first nozzle array.

18. The inkjet printing apparatus according to claim 8, wherein the pattern printing control unit causes the print head to print the first pattern and the second pattern according to data indicating that the first pattern and the second pattern are to be recorded in the same position on the print medium.

19. The inkjet printing apparatus according to claim 8, wherein the pattern data is set to print the first pattern and the second pattern in the same position on the print medium.

* * * * *